United States Patent [19]

Tardy

[11] Patent Number: 4,633,762

[45] Date of Patent: Jan. 6, 1987

[54] SPEED LIMITING DEVICE DESIGNED TO EQUIP THE SLIDE VALVE OF A HYDRAULIC SYSTEM

[75] Inventor: Maurice Tardy, Lorette - Loire, France

[73] Assignee: Bennes Marrel, France

[21] Appl. No.: 623,825

[22] Filed: Jun. 22, 1984

[51] Int. Cl.[4] ..... F15B 11/08

[52] U.S. Cl. ..... 91/461; 91/370; 91/371; 91/433; 137/625.66

[58] Field of Search ..... 137/625.66; 91/370, 91/371, 420, 433, 461, 28, 33

[56] References Cited

U.S. PATENT DOCUMENTS

| | | | |
|---|---|---|---|
| 3,706,322 | 12/1972 | Carlson | 137/625.66 |
| 3,862,643 | 1/1975 | Dezelon et al. | 91/461 |
| 3,893,471 | 7/1975 | Byers, Jr. | 91/433 |
| 3,988,966 | 12/1976 | Leonard | 91/461 |
| 4,438,827 | 3/1984 | Long | 91/371 |
| 4,463,819 | 8/1984 | Becker et al. | 137/625.66 |

*Primary Examiner*—A. Michael Chambers

*Attorney, Agent, or Firm*—Remy J. VanOphem

[57] ABSTRACT

A speed limiting hydraulic slide valve. The slide valve is provided with control pressure chambers at each end thereof. The slide is provided with a longitudinal passage at each end and this passage opens into the adjacent control pressure chamber. Each passage is normally closed by a check valve. Each longitudinal passage communicates with a peripheral passage on the valve of the slide by means of a radial passage. If the hydraulic actuator, such as a cylinder, begins to move too rapidly, the pressure in the radial passage will drop, and the pressure in the appropriate control pressure chamber will thereupon overcome the check valve in the passage which opens into such chamber, and this will cause the valve slide to move in a direction which will decelerate the action of the cylinder.

5 Claims, 4 Drawing Figures

SPEED LIMITING DEVICE DESIGNED TO EQUIP THE SLIDE VALVE OF A HYDRAULIC SYSTEM

BACKGROUND OF THE INVENTION

1. Field of the Invention

This invention relates to a slide valve for controlling the operation of a hydraulic actuator, such as a cylinder. More particularly, this invention relates to a slide valve with a speed limiting device for controlling the operation and the speed of operation of a hydraulic actuator such as a cylinder.

2. Description of the Prior Art

It is known to control the operation of a hydraulic actuator such as a cylinder by means of a slide valve which slides between two extreme positions as a result of a control pressure applied to one or another of its ends.

A slide valve as described may be used, for example, to apply an inlet pressure in one chamber of a cylinder whose other chamber is interconnected with the return tank. A hydraulic system using such a slide valve performs satisfactorily as long as the displacement of the piston of the cylinder occurs against a counter pressure. However, whenever the piston of the cylinder is not subjected to such a counter pressure, it is likely to operate faster than the speed set by the inflow, and this may cause a pressure drop upstream from the cylinder, due to the acceleration of the displacement of its piston.

SUMMARY OF THE INVENTION

The present invention is designed to eliminate these disadvantages by offering a hydraulic slide valve with speed limiting characteristics to maintain constant operating speed of the cylinder piston during extension and retraction.

A speed limiting slide valve according to the present invention includes a control pressure intake chamber at each end of the slide valve.

The outside surface of the slide of the slide valve includes several grooves whose axial length is determined by the arrangement of the grooves which are provided in the housing of the slide valve. The groove in the slide valve housing which is used to feed the cylinder has a radial bore which opens into a longitudinal conduit provided inside the slide valve. The internal conduit extends to one end of the slide valve where it communicates with the respective control chamber. A movable ball plug is provided inside the conduit, which has a fixed seat for the ball plug, to close off flow through the conduit when the pressure difference to which it is subjected causes it to close. Thanks to this arrangement, it becomes clear that when the cylinder piston accelerates in its displacement, the pressure will drop inside the the internal conduit, and this will cause the ball plug to unseat which will permit flow through the internal conduit toward the inside of the slide valve, causing the slide valve to return against that control pressure to limit the rate of displacement of the cylinder piston.

According to another feature of the invention, the slide valve housing includes a central inlet groove which is located between the two grooves provided to direct the pressure upstream or downstream of the cylinder. Each of the pressure directing grooves is connected, by means of a radial bore, with a single longitudinal conduit located inside the slide valve. In other words, two conduits are provided inside the slide valve, each one extending for approximately one half of the length of that slide valve, with each of them having the ball plug in such conduit near an end of the slide valve.

The present invention will be better understood by reference to the drawing and the description thereof, which is not intended to limit the invention.

BRIEF DESCRIPTION OF THE DRAWINGS

FIG. 2 is a schematic view which illustrates an alternative embodiment of the present invention, an embodiment which contains sensing grooves in the valve housing which permit the invention to be utilized with an external device such as a governor for control of a variable displacement pump or the like;

DETAILED DESCRIPTION OF THE PREFERRED EMBODIMENT

Figure 1:
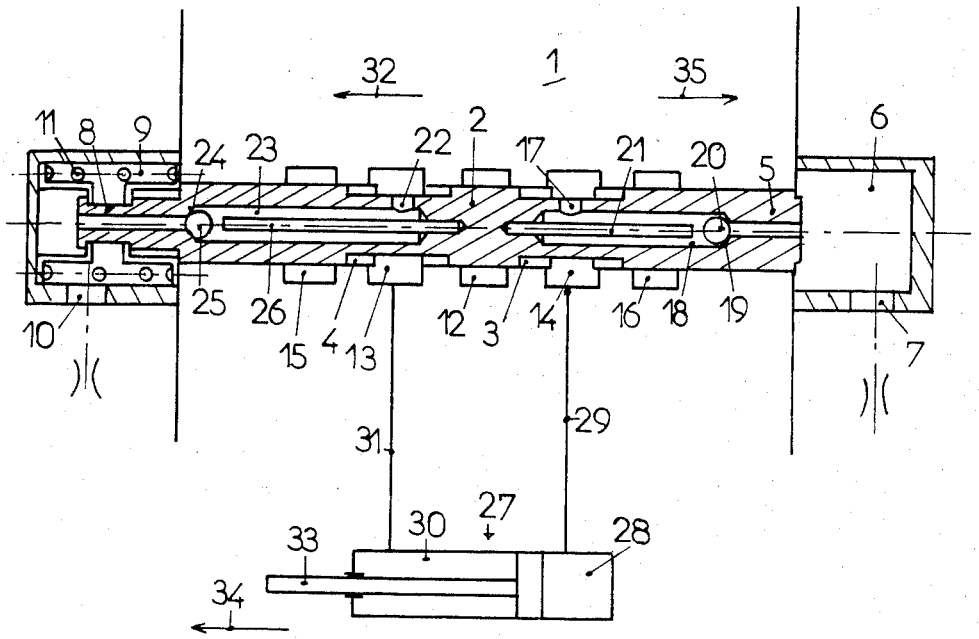
FIG. 1 is a schematic view which illustrates a preferred embodiment of a slide valve according to the present invention.

The slide valve illustrated FIG. 1, includes a housing 1 which houses a slide 2. The slide 2 is axially movable within the housing 1 and includes two peripheral grooves 3 and 4. The end 5 of the slide opens into a pressure control chamber 6. The pressure control chamber 6 is exposed to pressure through a pressure inlet 7. At the opposite side, the end 8 of the slide opens into another pressure control chamber 9. The pressure control chamber 9 is provided with an inlet 10 which allows for the inflow of a control pressure. A neutrally positioned return spring 11 is provided inside the pressure control chamber 9.

Five ring grooves are machined into the housing 1, and these ring grooves are as follows:

a centrally located feed groove 12 which is connected with a power feed pressure;

two grooves 13 and 14, located on either side of the feed groove 12; and two grooves 15 and 16 which are located near the ends of the slide valve, each of which connects with the return tank, not shown.

The peripheral groove 3 of the slide 2 is connected by means of a radial bore 17 to an internal longitudinal conduit 18. The internal conduit 18 opens into the control chamber 6. A check valve which is made up of a ball plug 20 whose displacement is limited by a fixed, internal stop piece 21 and by a valve seat 19 is provided within the internal conduit 18.

Similarly, the peripheral groove 4 of the slide 2 is connected by a radial bore 22, to an internal, longitudinal conduit 23. The internal conduit opens into the control chamber 9 and contains a check valve which is made up of a ball plug 25 which moves freely in the conduit 23 between a stop piece 26 and a valve seat 24.

In the embodiment illustrated in FIG. 1, it has been assumed that the hydraulic actuator is a double-acting reciprocating cylinder 27 whose large section chamber 28 is connected to the groove 14 by a conduit 29, whereas its small section chamber 30 is connected to the groove 13 by a conduit 31.

The slide 2 operates in the following manner:

As a control pressure is sent through the pressure inlet 7, the slide 2 moves to the left, as indicated by arrow 32, so as to connect the peripheral grooves 3 and 14 and the conduit 29 and the chamber 28 with the pressure inlet groove 12. Likewise, the grooves 4 and 13 are connected with the tank return groove 15. Therefore, the piston rod 33 of the reciprocating cylinder 27 moves in the direction indicated by arrow 34.

If, as a result of the load against the piston rod 33, it is caused to move faster than the speed set by the fluid flow in the conduit 29, a pressure drop will occur in the groove 14. This pressure drop will be communicated to the internal conduit 18 through the radial bore 17, and this will cause the ball plug 20 to unseat from the valve seat 19. The control pressure is, therefore, also communicated to the chamber 6. When the control pressure drops in the chamber 6 as described the slide 2 will move in the direction indicated by arrow 35. This will reduce the flow of fluid from the groove 13 to the groove 15 through the groove 4, and, as a result, it will also reduce the return flow in the conduit 31 and slow the motion of the piston rod 33.

The operation of the slide 2 is reversed when an initial control pressure is communicated to the chamber 9 through the inlet 10. This pressure moves the slide 2 to the right, as indicated by the arrow 35, thereby connecting the peripheral groove 4, the groove 13, the conduit 31 and the chamber 30 with the pressure feed groove 12 to push the piston rod 33 of the cylinder 27 in a direction opposite to that indicated by arrow 34.

Figure 2:
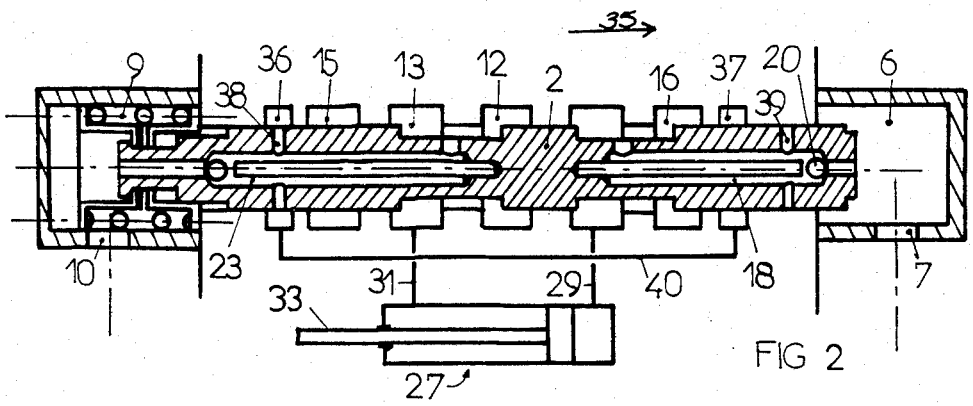
Figure 3:
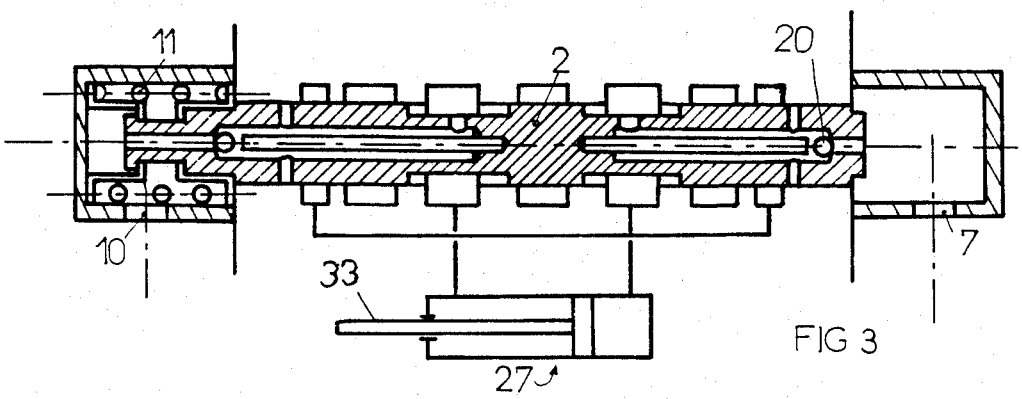
FIG. 3 is a schematic view which illustrates the slide valve of FIG. 2 in another position.
Figure 4:
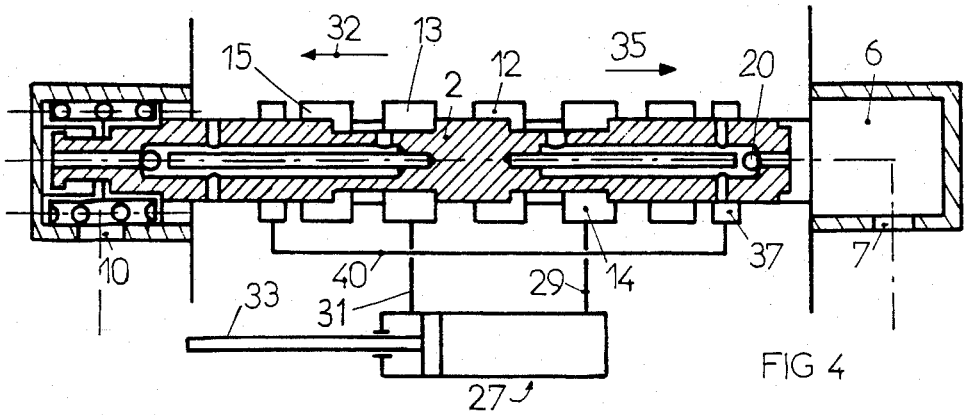
FIG. 4 is a schematic view which illustrates the slide valve of FIG. 2 in yet another position.

In the embodiment illustrated in FIGS. 2 through 4 provisions have been made for the slide 2 to be equipped with a system pressure sensor, which is usually called "load sensing" device.

The slide valve of the embodiment of FIGS. 2 through 4, which is otherwise similar to the one illustrated in FIG. 1, also includes two sensor grooves 36 and 37 in the slide 2, outside of the grooves 15 and 16, respectively. The sensor groove 36 is interconnected by a radial bore 38 with the internal longitudinal conduit 23. Likewise, the sensor groove 37 may be connected with the internal longitudinal conduit 18 through a radial bore 39.

The sensor grooves 36 and 37 are interconnected by an external sensor conduit 40.

The device operates as follows:

Whenever the control pressure is sent into the chamber 9, the displacement of the slide 2 in the direction of the arrow 35 causes either groove 12 and the groove 13 to be connected by the groove 4, so that the fluid pressure in the pressure feed groove 12 is applied in conduit 31 and causes the piston rod 33 of the cylinder 27 to retract.

Simultaneously, the inlet pressure enters the sensor groove 36, so that the sensor conduit 40 senses the fluid pressure in the piston rod 33 portion of the cylinder 27. This pressure in the sensor conduit 40 is then connected to an external device, such as a governor, not shown, which may be calibrated to be used as a pressure limiter or as a controller for a variable displacement pump, or the like.

When no inlet control pressure is applied in either of the pressure control chamber 6 or 9, the slide 2, which is controlled by the return spring 11, comes to a central position in which the cylinder 27 is hydraulically locked, as is illustrated in FIG. 3.

Alternatively, when the control pressure is applied to the pressure control chamber 6, as is illustrated in FIG. 4, the slide 2 moves in the direction indicated by arrow 32 so as to apply the pressure from the groove 12 into the conduit 29, thus causing the piston rod 33 of the cylinder 27 to extend. Simultaneously, the inlet pressure is sensed in the sensor groove 37 and in the sensor conduit 40, where it is used to control the operation of a governor or similar device, not shown.

A pressure drop in the groove 14, due to an acceleration of the piston rod 33 of the cylinder 27, will cause the ball plug 20 to open. This will cause a reduction in the pressure in the pressure control chamber 6, and will cause the slide 2 to move to the right in the direction of the arrow 35 toward the position of the slide 2 which is illustrated in FIG. 2. This will reduce the flow from the groove 13 to the groove 15, which, in turn, will restrict the flow through the conduit 31 and decelerate the motion of the piston rod 33.

Having thus described the present invention by way of an exemplary embodiment, it will be apparent to those skilled in the art that many modifications may be made from the exemplary embodiment without departing from the spirit of the present invention or the scope of the claims appended thereto.

What is claimed is:

1. A speed limiting hydraulic valve comprising:

a valve housing;

a slide which is slidable within said valve housing;

first and second control pressure chambers disposed at opposite ends of said valve housing, each end of said slide being in communication with the control pressure chamber which is disposed at the end of the housing which is adjacent to said end of said slide;

a plurality of grooves in said valve housing, said plurality of grooves in said valve housing comprising:

a first sensing groove adjacent one end of said valve housing;

a second sensing groove adjacent the other end of said valve housing;

the pressures in said first and second sensing grooves being adapted to be used to control the operation of said hydraulic valve by an external device, such as a governor;

a plurality of grooves in said slide, said grooves in said slide comprising first and second longitudinally spaced apart and longitudinally extending peripheral grooves in said slide;

certain of said grooves in said valve housing being in fluid communication with certain of said grooves in said slide when said slide is in a first position within said valve housing to cause hydraulic fluid to flow in a first direction through said valve, and certain of said grooves in said valve housing being in fluid communication with certain of said grooves in said slide when said slide is in a second position within said valve housing to cause hydraulic fluid to flow in a second direction through said valve;

first and second longitudinally extending passages within said slide, said first longitudinally extending passage opening into the first of said control pressure chambers and said second longitudinally extending passage opening into the second of said control pressure chambers;

a third radial passage connecting said first sensing groove to said first longitudinally extending passage; and a fourth radial passage connecting said second sensing groove to said second longitudinally extending passage;

a first radial passage connecting said first peripheral groove to said first longitudinally extending passage;

a second radial passage connecting said second peripheral groove to said second longitudinally extending passage;

first check valve means within said first longitudinally extending passage;

second check valve means within said second longitudinally extending passage;

said first check valve means being adapted to open to permit the control pressure in said first control pressure chamber to move said slide toward said second control pressure chamber to control the rate of hydraulic fluid flow in said first direction; and said second check valve means being adapted to open to permit the control pressure in said second control pressure chamber to move said slide toward said first control pressure chamber to control the rate of hydraulic fluid flow in said second direction.

2. The speed limiting hydraulic valve according to claim 1 wherein each of said first and second longitudinally extending passages extends for approximately one-half the length of said slide.

3. The speed limiting hydraulic valve according to claim 1 wherein a pressure drop occurs in said first longitudinally extending passage when the rate of hydraulic fluid flow in said first direction increases and said first check valve means opens to permit control pressure from said first control pressure chamber to enter said slide and to cause said slide to move toward said second control pressure chamber, thereby reducing the rate of hydraulic fluid flow in said first direction.

4. The speed limiting hydraulic valve according to claim 1 and further comprising conduit means connecting said first sensing groove to said second sensing groove, the pressure in said conduit means being adapted to control the operation of said hydraulic valve.

5. The speed limiting hydraulic valve according to claim 1 and further comprising:

a double-acting cylinder comprising a piston rod;

said double-acting hydraulic cylinder being hydraulically connected to said hydraulic valve so that the flow of said hydraulic fluid in said first direction causes said piston rod to extend from said cylinder; and the flow of said hydraulic fluid in said second direction causes said piston rod to retract into said cylinder;

the control of the rate of hydraulic flow in said first direction from said hydraulic valve to said cylinder resulting from a restriction in the rate of the return flow in from said cylinder to said hydraulic valve, as a result of the increase in the back pressure of hydraulic fluid against said piston rod.

* * * * *

UNITED STATES PATENT AND TRADEMARK OFFICE

CERTIFICATE OF CORRECTION

PATENT NO. : 4,633,762

DATED : January 6, 1987

INVENTOR(S) : Maurice Tardy

It is certified that error appears in the above-identified patent and that said Letters Patent is hereby corrected as shown below:

In the Claims

Column 4, line 39, kindly insert a paragraph indention.

Signed and Sealed this

Twentieth Day of October, 1987

*Attest:*

DONALD J. QUIGG

*Attesting Officer*

*Commissioner of Patents and Trademarks*